US005573098A

United States Patent [19]

Widmer

[11] Patent Number: 5,573,098

[45] Date of Patent: Nov. 12, 1996

[54] CARD-ACTIVATED LOCK MECHANISM

[75] Inventor: Stanley W. Widmer, Browerville, Minn.

[73] Assignee: Minnesota Lock, Inc., Rochester, Minn.

[21] Appl. No.: 397,301

[22] Filed: Mar. 1, 1995

[51] Int. Cl.[6] ..... E05B 35/08; G07F 17/14

[52] U.S. Cl. ..... 194/212; 70/339; 70/DIG. 41; 194/291

[58] Field of Search ..... 194/212, 253, 194/290, 291, 205, 210; 70/339, 353, 354, 387, 389, DIG. 41

[56] References Cited

U.S. PATENT DOCUMENTS 4,572,348 2/1986 Eisermann et al. ..... 194/248
4,817,404 4/1989 Eisermann et al. ..... 70/134
4,918,957 4/1990 Eisermann ..... 70/276

*Primary Examiner*—F. J. Bartuska
*Attorney, Agent, or Firm*—Moore & Hansen

[57] ABSTRACT

A lock adapted to be used in conjunction with a slidably insertable card comprises a front housing segment and a rear housing segment, a bolt movable along a slide path from a normally open position to a fully locked position, a card housing, a lockout member with a first blocking position and movable to a second release position, a blocking member affixed to the lockout member, and normally disposed in the slide path of the bolt but movable out of the slide path of the bolt. The lockout member also has a peg that engages opening in the card and in the front housing segment constructed and arranged to receive the peg and allow free movement of the bolt into the fully locked position. An improper card or a proper card inserted improperly will not allow the peg to move into the opening, and the blocking member will remain in the slide path of the bolt, preventing the lock from being locked.

16 Claims, 4 Drawing Sheets

CARD-ACTIVATED LOCK MECHANISM

BACKGROUND OF THE INVENTION

The present invention relates to the field of locks. Specifically it relates to card-activated locks.

It has become a common practice in the recreational and fitness fields for proprietors of recreational and fitness establishments to provide lockers for storage of personal items during the time that the patron is at the establishment. Security of such personal possessions is therefore a large concern. Many such establishments provide lockers capable of being locked by the use of a user-provided padlock or combination lock. More recently, clubs began providing members or visitors with locks for use at the club. This has led to the requirement for the club to keep track of combinations for locks, to track keys for locks, to look up combinations for patrons who have lost combinations, to replace lost keys, and the like. Keys are easily lost, and combinations easily forgotten.

Cards carried by members or issued to a guest at a hotel, a club, or an athletic facility have been used previously to activate a locking mechanism. Previous lock designs have included magnetically operated devices for scanning and reading a punch card. For example, U.S. Pat. No. 4,572,348 (Eisermann et al.) discloses a lock with a magnetic assembly that introduces a magnetic pin into a hole in a card in order to allow free movement of a bolt. Such magnetic devices are subject to failure and operational difficulties. The present invention uses no magnetic means for operation, but rather relies on purely mechanical actuation to allow movement of a bolt into a fully locked position.

BRIEF SUMMARY OF THE INVENTION

It is an objective of the present invention to provide a purely mechanically operated locking mechanism that may be activated by a card configured for operation of the mechanism, or by a coin or token.

The present invention eliminates the need for non-mechanical elements in a card-activated locking mechanism by using purely mechanical action. The locking mechanism allows operation by use of a card, a coin, or a token, depending on the desire of the proprietor and user. A reversible coin/token slot allows for easy changeover from coin operation to token operation, and from token operation to coin operation. The card may be used at any time, whether the locking mechanism is in coin or token operation.

The card-activated lock mechanism is contained in a housing comprised of front and rear housing segments. Other components include a slide bolt, a card housing, and two separate lockout mechanisms, upper and lower. The bolt of the lock is normally open. The card housing receives an actuator card, made and configured like a plastic credit card. The lockout mechanisms function to prevent the lock from being fully locked without use of a coin, token, or proper card.

The upper lockout operates all of the time, unless a card or a proper coin or token is inserted. If a proper coin or token is inserted, the upper lockout .function is disabled, and the bolt may be moved to its fully locked position. An inserted card will also disable the upper lockout. An improper card, or a proper card incorrectly inserted, will disable the upper lockout, but the movement of the bolt to a fully locked position will be stopped by the lower lockout.

The lower lockout operates only when an improper card is inserted into the lock, or when a proper card is inserted into the lock incorrectly. The lower lockout is normally bypassed. It is a factor in the locking function of the card-activated locking mechanism only when a card has been inserted into the card housing.

In accordance with a preferred embodiment of the lower lockout mechanism, insertion of a properly configured card allows a segment of the blocking member to move into a passage in the card, thereby permitting movement of the blocking member out of the slide path of the bolt. Upon the improper insertion of a card, or an improperly inserted card, a lockout member, normally free to move from the slide path of the bolt and into an opening in the card, will be unable to so move, and a blocking member will impede free passage of the bolt to a locked position. The blocking member will remain in the slide path of the bolt because the passage or opening in the card will either not be present, or will not be in the proper position to accept the blocking member. Therefore, the bolt will not be able to travel into the fully locked position.

A further beneficial feature resides in the use of a lock housing plate injection molded in one piece to receive a key activated lock cylinder. Prior art lock housings have required several pieces and fasteners to hold them together. This construction greatly reduces material and labor costs.

These and other objects and benefits of the present invention will become apparent from the following detailed description thereof taken in conjunction with the accompanying drawings, wherein like reference numerals designate like elements throughout the several views.

DESCRIPTION OF THE PREFERRED EMBODIMENT

Figure 1:
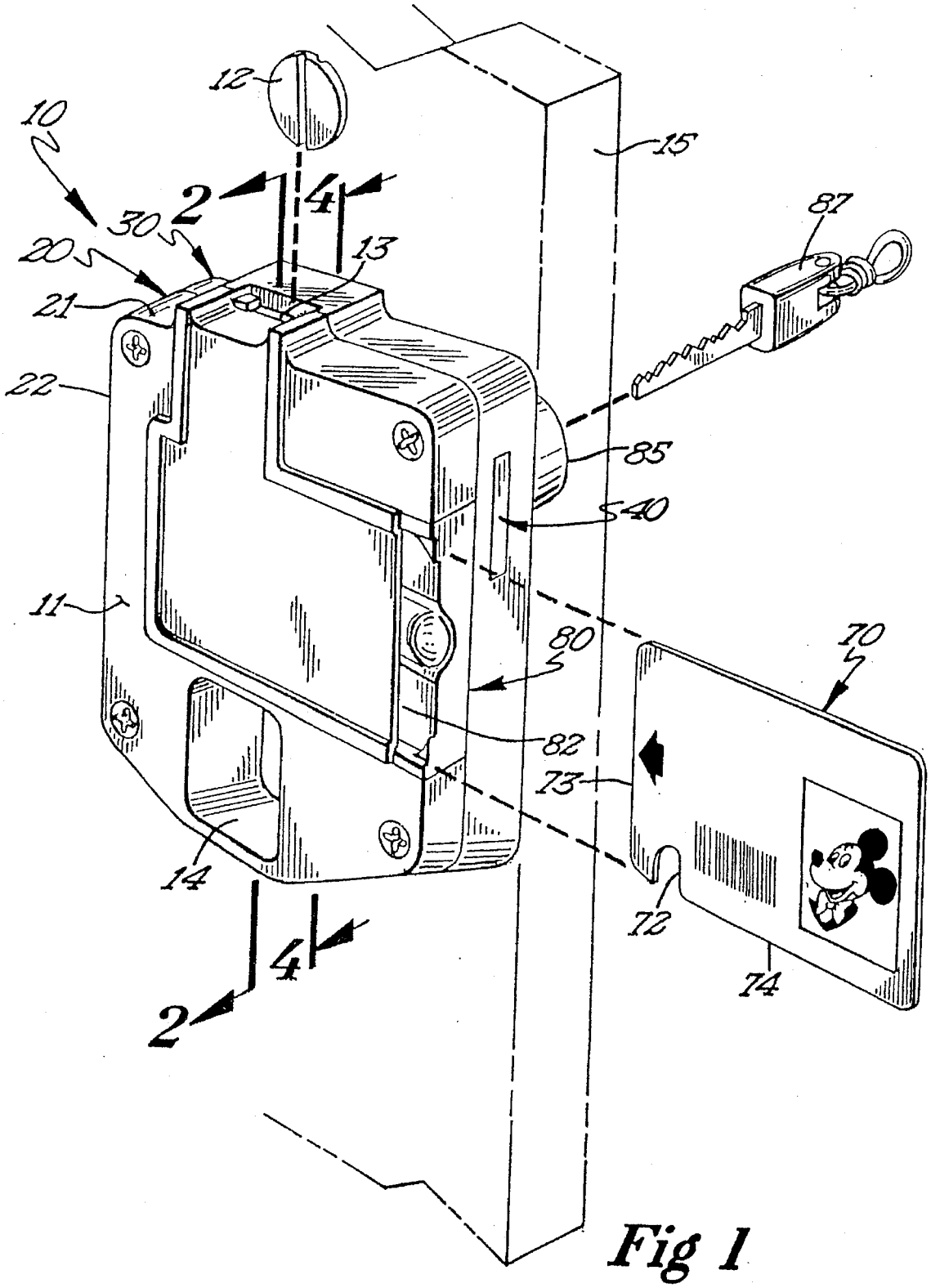
FIG. 1 is a perspective view of the assembled lock mechanism showing its placement on a typical door.
Figure 2:
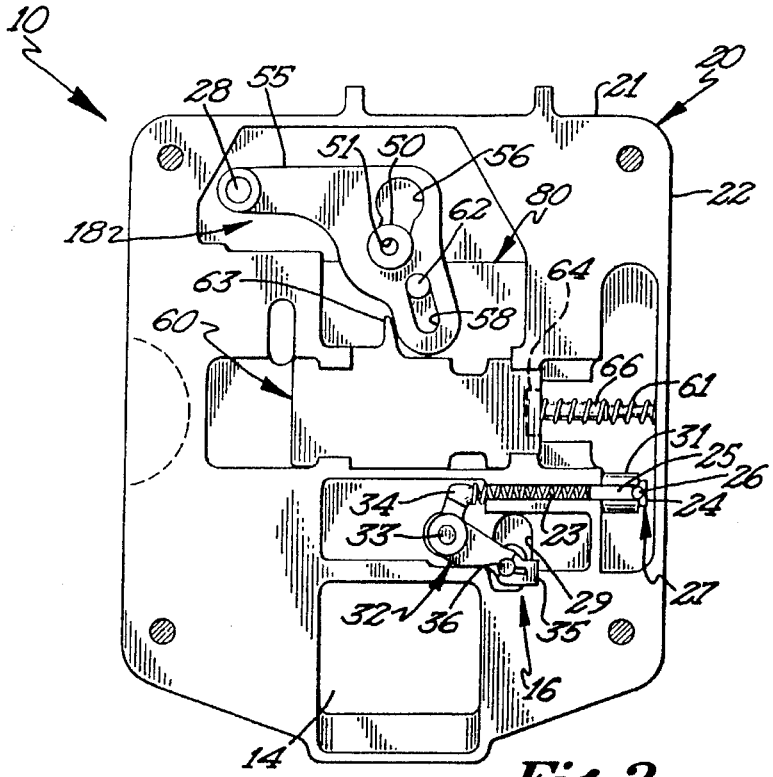
FIG. 2 is a rear view of the front housing segment of the lock mechanism, taken along line 2—2 of FIG. 1.
Figure 3:
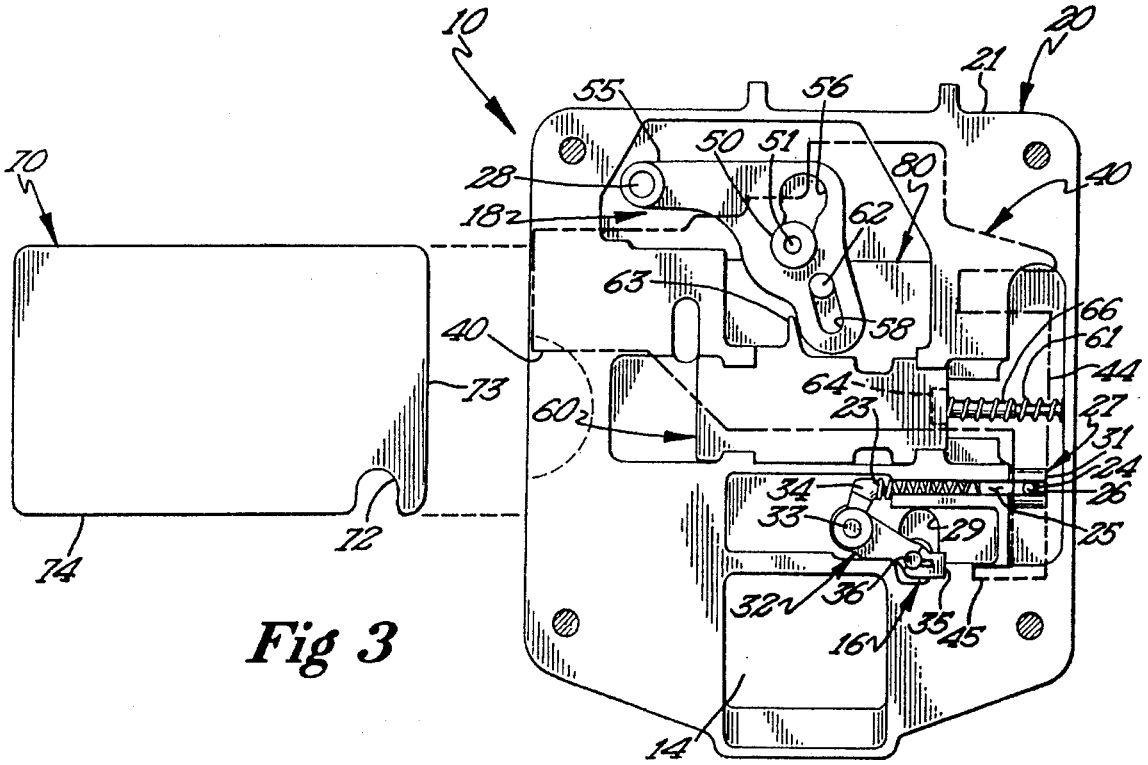
FIG. 3 is a rear view of the assembled front and rear housing segments of the lock mechanism showing the positioning of the bolt and the card, with the bolt in an unlocked position.
Figure 4:
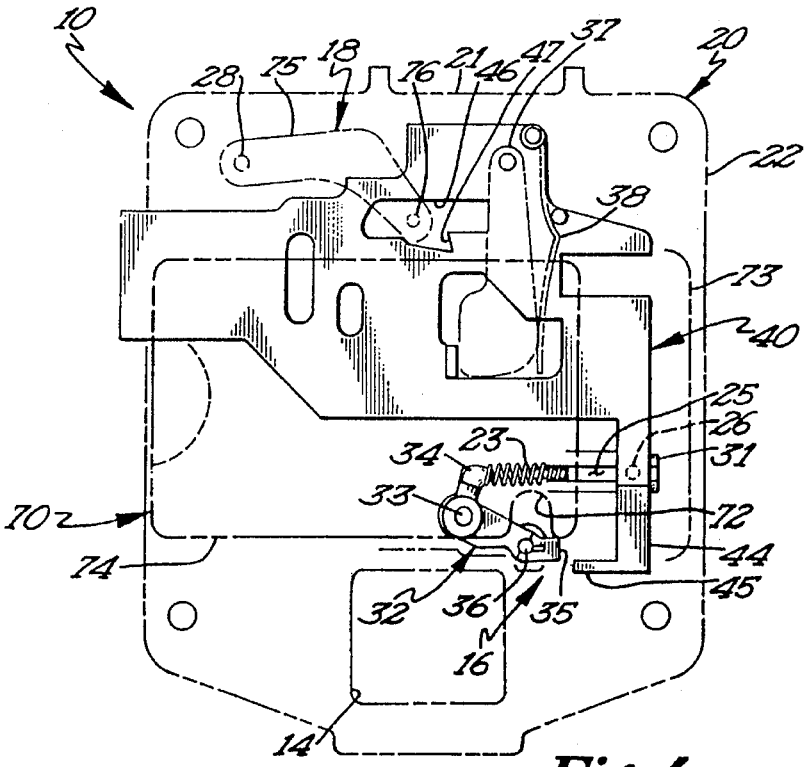
FIG. 4 is a rear view of the assembled front and rear housing segments of the lock mechanism showing the bolt as it begins to move toward the locked position, taken along line 4—4 of FIG. 1.
Figure 5:
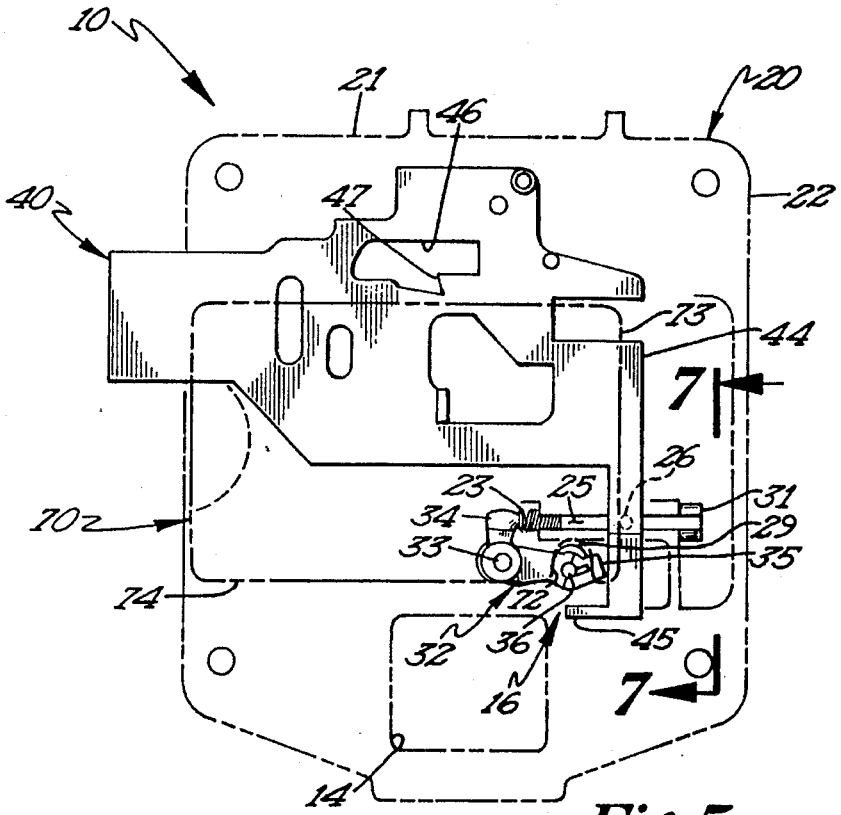
FIG. 5 is a rear view of the assembled front and rear housing segments of the lock mechanism showing the bolt in a fully locked position.

Referring first to FIG. 1, the card activated lock mechanism 10 may be seen in typical position on a door 15. The card-activated locking mechanism 10 has a front housing segment 20 and a rear housing segment 30, each injection molded in a single piece. The front housing segment 20 has an opening to receive a card housing 80. Referring also to FIGS. 2–3, the card housing 80 receives a card lockup slide 60, which is spring biased away from card receiving opening 82 by a compression spring 61. The card-activated lock mechanism 10 has two separate lockout systems, lower lockout 16 and upper lockout 18. Card 70 can be seen to have passage means 72, which is preferably a notch as shown in FIG. 1. The card 70 fits into card housing 80. The card activated lock mechanism 10 will accept card 70 or coin or token 12 as an actuator. Rear housing segment 30 contains a coin/token receiving opening 13 for receiving the coin or token 12. Rear housing segment 30 also receives a reversible coin/token receiving means 13*a*, which is known in the art. The reversible coin/token receiving means 13*a* allows the mechanism 10 to be configured to accept either a coin or a token.

Referring to FIGS. 2–5, upper lockout 18 may be seen. Upper lockout 18 is comprised of swing cam 55 which is pivotally mounted at mounting peg 28 of front housing segment 20. Swing cam 55 has opening 56 in which bushing 50 is positioned. Bushing 50 has a central opening 51. Swingarm lockout 75 (FIG. 4) is also pivotally mounted at mounting peg 28. Swingarm lockout 75 has peg or protrusion 76 extending toward front face 11 of the lock mechanism 10. Protrusion 76 of swingarm lockout 75 extends through the back of rear housing segment 30 into opening 51 of bushing 50. Swing cam 55 is also slidably mounted on peg 62 of card lockup slide 60. Swing cam 55 has oblong opening 58 which serves as the mounting opening for peg 62. Swingarm lockout 75 is normally spring biased clockwise. In this configuration (FIG. 4), peg 76 will normally engage recess 47 formed in opening 46 in bolt 40 as bolt 40 is moved towards its fully locked position from its normally open position. This engagement between peg 76 and bolt recess 47 prevents movement of bolt 40 to its fully locked position.

When lock mechanism 10 is in the configuration accepting tokens, it will not accept an improperly configured or sized token. When in coin-operated configuration, a coin larger than the coin opening 13 will not fit into the mechanism 10. A coin smaller than the coin opening 13 will fall through the mechanism 10 to coin return opening 14 because coin gauge arm 37 that is disposed in the rear housing segment 30 is sized and biased to hold only a coin or token of proper size. If a coin falls through the mechanism 10, it will not be in proper position to disengage upper lockout 18. The coin or token 12, when held in the mechanism 10, will form a barrier over bolt recess 47. Protrusion 76 will therefore be unable to seat in bolt recess 47 to block locking movement of bolt 40.

The insertion of the card 70 will also disable the upper lockout 18 of the lock mechanism 10. Use of the card 70 will disable upper lockout 18 by causing swing cam 55 and bushing 50 to move swingarm lockout 75 and therefore protrusion 76 away from bolt recess 47. When card 70 is inserted into card housing 80, first edge 73 contacts spring mount plate 64 (FIG. 2) and pushes card lockup slide 60 toward the fight, relative to the figures. Arm 63 on slide 60 engages swing cam 55, causing it to rotate counter-clockwise, thereby moving bushing 51 and therefore protrusion 76 out of position to engage bolt recess 47.

Figure 6:
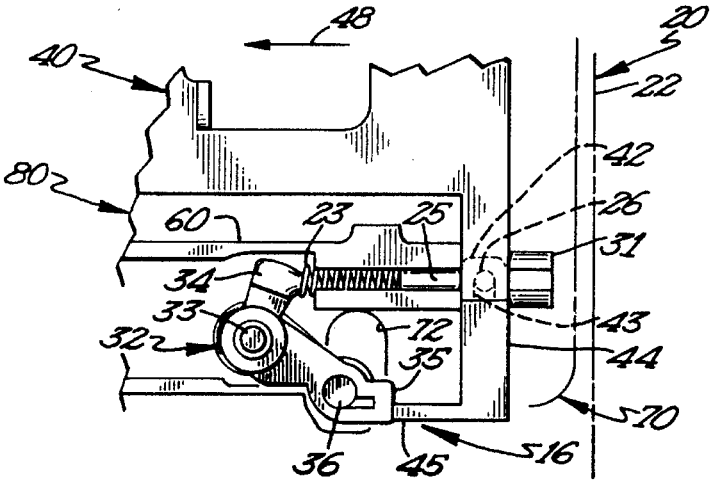
FIG. 6 is an enlarged view of the lockout member blocking movement of the bolt.
Figure 7:
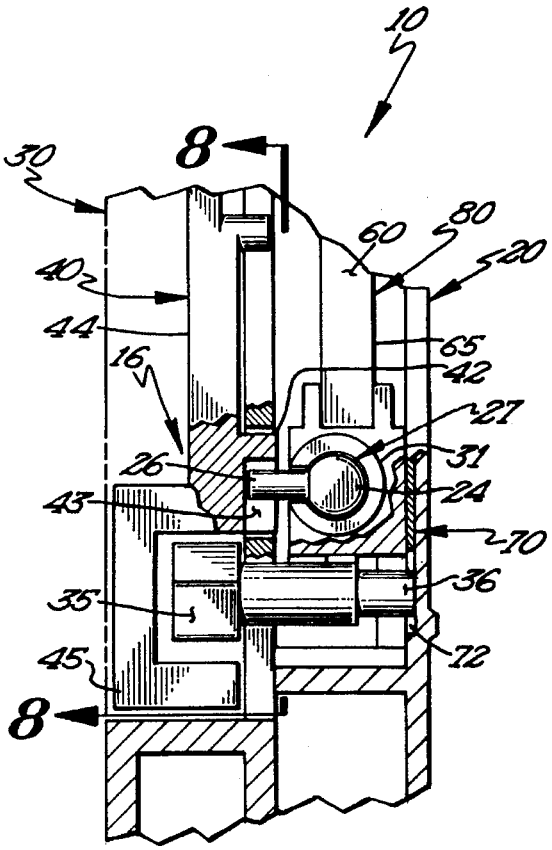
FIG. 7 is a fight side view of the lockout member portion of the assembled lock mechanism, taken along line 7—7 of FIG. 5.
Figure 8:
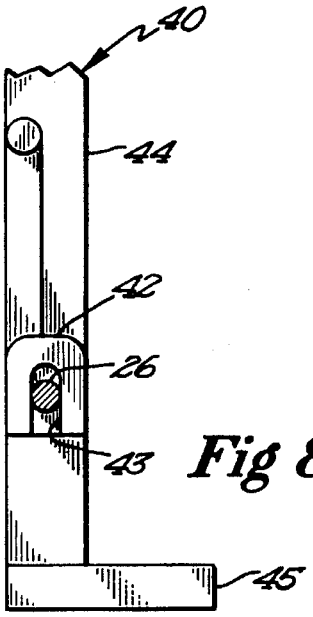
FIG. 8 is a right side view of the bolt, taken along line 8—8 of FIG. 7.
Figure 9:
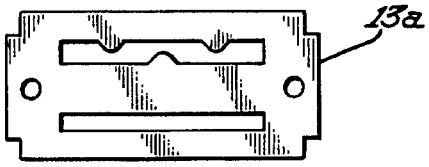
FIG. 9 is an elevation view of the reversible coin/token receiving means.

Lower lockout 16 is comprised of lockout member 32, bolt 40, piston 27 and spring 23. Lockout member 32 is pivotally mounted at pivot point 33. Piston 27 and spring 23 are disposed in card housing 80, with piston 27 slidably disposed in piston slide 31. Lockout member 32 is normally spring biased clockwise by biasing spring 100 as viewed in FIG. 6. In this normal position, lockout member 32 has blocking member 35 disposed in the slide path of stop member 45 carried on depending blocking leg 44 of bolt 40. Depending blocking leg 44 of bolt 40 also has U-shaped race track 42 (FIG. 8), which engages piston arm 26 of piston 27. As bolt 40 begins motion toward its fully locked position, the engagement of race track 42 and piston arm 26 causes piston 27 to be moved along with bolt 40 in the direction indicated by the arrow 48 in FIG. 6. Contact surface 43 located on the inner portion of the U of race track 42 pushes piston 27 in the same direction as bolt 40. Piston 27 has piston shaft 25 that engages spring 23. Preferably, piston shaft 25 has an attachment ring at its connection to piston head 20 onto which spring 23 attaches. This attachment is to allow spring 23 to be pulled and moved by the motion of piston 27 without the spring 23 losing contact with piston 27. Spring 23 is preferably tapered so that it is widest at the point at which it connects to piston shaft 25, and narrowest at its opposite end. At its opposite end, spring 23 comes in contact with cam link 34 of lockout member 32.

When bolt 40 begins motion toward its fully locked position, the engagement between piston 27, spring 23, and lockout member 32, will cause lockout member 32 to rotate counter-clockwise into a release position. Blocking member 35, located at the opposite end of lockout member 32 from cam link 34, will accordingly rotate out of the slide path of stop member 45 of depending leg 44 of bolt 40. Blocking member 35 has peg or protrusion 36 that extends toward front face 11 of lock mechanism 10. The peg or protrusion 36 on the lockout member 32 moves into a notch 29 in the card housing 80 which corresponds to the passage 72 in the activation card 70. Movement of the bolt 40 will thereby move the piston 27 and the lockout member 32 with its corresponding blocking member 35 and peg 36. When the card 70 inserted is improper, peg 36 will not be allowed to move into the openings 29 and 72. Peg 36 is blocked by the lack of a card notch 72 in the proper position. When this happens, blocking member 35 on the lockout member 32 will restrain the stop member 45 from moving, and hence the bolt 40 from fully extending, and not allow locking. This blocking member 35 normally rotates out of the slide path of stop member 45 when the bolt 40 begins to move from a fully open to a fully closed position. However, if the passage 72 in the properly configured card 70 is not present, the blocking member 35 will not be able to move out of the slide path of stop member 45, and the bolt 40 will be unable to pass to its fully locked position.

In operation, the lower lockout 16 functions as follows. Upon the improper insertion of a card 70, or an improperly configured card, lockout member 32, normally disposed in the slide path of the stop member 45 but free to move from the slide path of the stop member 45 and into passage means 72 on the card 70, will be unable to so move. Protrusion or peg 36 on the lockout member 32 normally moves into the passage 72 and opening 29 on the card 70 and in the front housing segment 20, respectively. A card 70 that is improperly inserted, or that is not otherwise a proper card, will not have the passage means 72 in the proper position for the protrusion 36 of the lockout member 32 to engage. Blocking member 35 attached to the lockout member 32 will impede free passage of stop member 45 of depending leg 44 and prevent bolt 40 from moving to a fully locked position, since the blocking member 35 is normally disposed in the slide path of the bolt 40, and more specifically of stop member 45 of depending blocking leg 44 of bolt 40, and can only move out of the slide path by moving into notch 29 of front housing segment 20 and passage means 72 of properly configured card 70 that has been properly inserted.

When an improperly configured card is inserted into card housing 80, there will be no passage means 72 into which peg 36 can be moved. Because of this, blocking member 35 will remain in the slide path of stop member 45 of depending blocking leg 44 of bolt 40, and bolt 40 will be unable to move to its fully locked position.

Spring 23 is used in lower lockout 16 to allow full travel of bolt 40 to its fully locked position even after lockout member 32 has been pivoted as far as notch 29 will allow and blocking member 35 is out of the slide path of bolt 40. In order for bolt 40 to move to its fully locked position, the travel distance of piston 27 cannot be limited by cam link 34 of lockout member 32. The compression of spring 23 allows piston 27 and therefore bolt 40 to continue travel toward the fully locked position, yet still allows peg 36 to be stopped by notch 29 of front housing 20. If piston shaft 25 were to extend fully to cam link 34, movement of bolt 40 to its fully locked position would require modification of lower lockout 16. Such modification is well within the limits of one of ordinary skill in the art. However, the preferred configuration is as described herein.

Insertion of a properly Configured card 70 allows pivotal motion of lockout member 32, so blocking member 35 will engage the passage 72 in the card 70, removing the blocking member 35 from the slide path of the bolt 40. An improperly inserted card 70, or an incorrect card, will not allow the passage of the blocking member 35 out of the slide path of the bolt 70, because the passage 72 in the card 70 will either not be present, or will not be in the proper position to accept the peg 36. Therefore, the bolt 40 will not be able to travel into the fully locked position. When passage means 72 is not in proper position, notch 29 of front housing segment 20, which normally accepts peg 36 to remove peg 36 from the slide path of depending leg 44 of bolt 40, will be blocked by the lower edge 74 of card 70. Peg 36, attached to lockout member 32, will be unable to move from the slide path of bolt 40. Bolt 40 will be unable to move due to impedance of the path of stop member 45 by blocking member 35, and bolt 40 will not be movable to a fully locked position.

Card 70 will deactivate upper lockout 18 as follows. It can be seen in FIGS. 2 and 3 that this mounting structure allows swing cam 55 to be moved by movement of card lockup slide 60. Card lockup slide 60 has arm 63 which engages swing cam 55. When card lockup slide 60 moves, arm 63 engages swing cam 55 and causes swing cam 55 to pivot. This moves bushing 50, which engages protrusion 76 of swingarm lockout 75, causing swingarm lockout 75 to pivot toward top 21 of front housing segment 20. Protrusion 76 will therefore be unable to engage bolt recess 47, and the bolt 40 may move freely to the fully locked position. When card 70 is inserted into card housing 80, card 70 will contact spring mount plate 64. Spring mount plate 64 extends outwardly from back 65 of card lockup slide 60. Compression spring 61 is backed against spring mount plate 64, and is mounted on peg 66. When card 70 contacts spring mount plate 64, edge 73 of card 70 pushes spring mount plate 64 and therefore card lockup slide 60 toward right side 22 of front housing segment 20. This causes arm 63 to contact and pivot swing cam 55, thus disabling upper lockout 18 as described above.

Coin or token 12 will deactivate upper lockout 18 as follows. When coin or token 12 is inserted into coin/token receiving opening 13, coin or token 12 will drop into position so as to deflect protrusion 76 of swingarm lockout 75 when bolt 40 begins to move into the fully locked position. Coin or token 12 is held in proper position by contact with coin gauge arm 37 and a protrusion on the bolt 40, not shown. Coin guage arm is biased by coin sizing spring 38. Coin or token 12 will force protrusion 76 to ride over bolt recess 47, allowing bolt 40 to move to fully locked position. Coin or token 12 may be retained or returned to the user following movement of bolt 40 back to unlocked position, in known fashion.

A cylinder 85 with a key activator 87 is positioned in a lock housing plate (not shown) in the conventional manner. The lock housing plate is preferably injection molded in one piece. A bolt driver cam (not shown) fits on the inner end of the cylinder 87, and engages the bolt 40 by way of a peg extending from its body in known fashion.

The detailed description outlined above is considered to be illustrative only of the principles of the invention. Numerous changes and modifications will occur to those skilled in the art, and there is no intention to restrict the scope of the invention to the detailed description. The preferred embodiment of the invention having been described in detail, the scope of the invention should be defined by the following claims.

What is claimed is:

1. A lock adapted to be used in combination with an activator card having passage means therein, said lock comprising:

a front housing segment and a rear housing segment;

a bolt movable along a slide path from a normally open position to a fully locked position;

a card housing constructed and arranged to receive the activator card;

a lockout member having a first bolt blocking position in said bolt slide path and a second release position permitting free movement of said bolt to its fully locked position, said lockout member being normally disposed in said first blocking position and movable to said second position;

means for blocking said bolt from moving to said fully locked position, said blocking means affixed to said lockout member and movable therewith, said blocking means normally disposed in said slide path of said bolt, and being movable out of said slide path of said bolt to allow said bolt to be moved to said fully locked position;

engaging means for engaging movement into the passage means on the activator card, said engaging means affixed to said lockout member, and the passage means receiving said engaging means when the card is inserted into said card housing in a predetermined position relative to said lockout member.

2. The lock according to claim 1, wherein said engaging means is a peg.

3. The lock according to claim 1, wherein said lockout member is a pivotal arm.

4. The lock according to claim 1, wherein:

said bolt has a depending blocking leg; and said blocking means is disposed in the travel path of said blocking leg.

5. The lock according to claim 1 wherein movement of said bolt toward said fully locked position moves said lockout member to said second position.

6. The lock according to claim 4, and further comprising:

a piston having a head, a shaft, and an arm extending laterally from said head perpendicular to said shaft; and wherein said depending leg has a contact surface which contacts said piston arm and moves said piston in a direction to move said lockout member to its said second position as said bolt is slidably moved toward its fully locked position.

7. The lock according to claim 6 wherein a compression spring is positioned between said piston and said lockout member, whereby said spring is compressed as said contact surface moves said piston toward said lockout member.

8. The lock according to claim 7 wherein said spring tapers from said piston to said lockout member, said spring narrowing toward said lockout member.

9. The lock according to claim 6 wherein said depending leg also has a stop member carried thereon, said stop member being located to contact said lockout member and prevent movement of said bolt to said fully locked position when said lockout member is in said first blocking position.

10. The lock according to claim 3 wherein a cam link extends from said pivotal arm in the travel path of said piston, whereby said piston pivotally displaces said cam link and thus swings said pivotal arm to its said second position by the movement of said piston by said contact surface.

11. The lock according to claim 3 wherein:

said pivotal arm has an actuating cam link at one end thereof and said blocking member is at its opposite end;

said bolt has a depending leg carrying a stop member which strikes said blocking member and prevents the sliding movement of said bolt to said fully locked position when said lockout arm is in said first blocking position.

12. The lock according to claim 7 wherein said piston shaft has an attachment ring to which said spring locks to hold said spring and said piston in constant contact.

13. A lock adapted to be actuated by insertion of an activator card, a token, or a coin, said lock comprising:

a front housing segment and a rear housing segment;

a bolt movable along a slide path from a normally open position to a fully locked position;

a card housing constructed and arranged to receive the activator card;

a lockout member having a first blocking means normally disposed so as to block said bolt from moving into said locked position unless the card has been properly inserted into said card housing;

said lockout member also having engaging means for engaging the properly inserted card;

a second blocking means blocking said bolt from traveling unless the coin, the token, or the card has been properly inserted into said card housing, the slidable insertion of the card into the card housing engaging and de-actuating said second blocking means;

whereby when said engaging means engages said passage means, said bolt may be moved freely to said locked position.

14. The lock according to claim 13, wherein the card has a bottom edge and an opening along said bottom edge to receive said engaging means, and wherein said engaging means is a peg fitting the opening.

15. The lock according to claim 13, wherein said rear housing segment has an opening, said opening configured to receive a reversible coin/token receiving means, said coin/token receiving means having a first opening and a second opening, said first opening being configured for a coin, and said second opening being configured for a token.

16. A card-activated lock mechanism comprising:

a front housing segment and a rear housing segment;

a bolt movable along a slide path from a normally open position to a fully locked position;

an activator card;

a card housing constructed and arranged to receive said activator card;

a lockout member having a first bolt blocking position in said bolt slide path and a second position permitting free movement of said bolt to its fully locked position, said lockout member being normally disposed in said blocking position and movable to said free position;

said card having passage means;

engaging means affixed to said lockout member so that said engaging means does not engage said passage means when said blocking member is disposed in said slide path;

means for blocking said bolt from moving to said fully locked position, said blocking means affixed to said lockout member and being normally disposed in said slide path, and being removable from said slide path to allow said bolt to move to said fully locked position;

said engaging means engaging said passage means allowing said blocking means to be removed from said slide path, when said card is inserted into said card housing in a predetermined position relative to said lockout member.

* * * * *

UNITED STATES PATENT AND TRADEMARK OFFICE

CERTIFICATE OF CORRECTION

PATENT NO. : 5,573,098

DATED : 11/12/96

INVENTOR(S) : Stanley W. Widmer

It is certified that error appears in the above-indentified patent and that said Letters Patent is hereby corrected as shown below:

Col. 3, line 60, after the words "toward the", delete "fight" and insert --right-- therefor.

Signed and Sealed this

Thirty-first Day of March, 1998

Bruce Lehman

*Attest:*

BRUCE LEHMAN

*Attesting Officer*

*Commissioner of Patents and Trademarks*